US005392204A

United States Patent [19]

Schumaker

[11] Patent Number: 5,392,204

[45] Date of Patent: Feb. 21, 1995

[54] LAMP HAVING A DIFFUSER AND SHADE

[75] Inventor: Michael J. Schumaker, Milwaukee, Wis.

[73] Assignee: Adjustable Fixtures Co., Milwaukee, Wis.

[21] Appl. No.: 147,693

[22] Filed: Nov. 4, 1993

[51] Int. Cl.[6] ..... F21V 1/10

[52] U.S. Cl. ..... 362/294; 362/448; 362/378; 362/373; 362/355; 362/353; 362/437

[58] Field of Search ..... 362/448, 378, 373, 355, 362/353, 376, 414, 437, 410, 363, 294

[56] References Cited

U.S. PATENT DOCUMENTS

| | | | |
|---|---|---|---|
| 177,921 | 5/1876 | Bonnell, Jr. | 362/361 |
| 275,641 | 4/1883 | Gordon | 362/361 |
| 443,169 | 12/1890 | Simpson | 362/355 |
| 589,489 | 9/1897 | Wolff | 362/361 |
| 977,358 | 11/1910 | Allen | 362/355 X |
| 1,040,072 | 10/1912 | Wehr | 362/361 |
| 1,546,350 | 7/1925 | O'Neil | 362/437 |
| 1,863,767 | 6/1932 | Shapiro | 362/361 |
| 1,977,401 | 10/1934 | Orth | 362/417 |
| 2,121,575 | 6/1938 | Shoemaker | 362/355 X |
| 2,138,373 | 11/1938 | Doane | 240/81 |
| 2,469,412 | 5/1949 | Roebken | 128/396 |
| 2,531,523 | 11/1950 | Moser | 362/433 |
| 3,077,537 | 2/1963 | Squier | 362/216 |
| 3,813,537 | 5/1974 | Lieberman | 362/353 X |
| 3,849,640 | 11/1974 | McCarthy | 362/437 |
| 4,293,899 | 10/1981 | Sanner | 362/294 |
| 4,498,125 | 2/1985 | Schumaker | 362/216 |
| 4,998,192 | 3/1991 | Arndt | 362/376 |

FOREIGN PATENT DOCUMENTS

| | | | |
|---|---|---|---|
| 527031 | 7/1921 | France | 362/417 |
| 2177488 | 1/1987 | United Kingdom | 362/355 |

*Primary Examiner*—Ira S. Lazarus
*Assistant Examiner*—Thomas M. Sember
*Attorney, Agent, or Firm*—Michael, Best & Friedrich

[57] ABSTRACT

A lamp has a cup shaped base which is open at its upper end, a lamp socket mounted in the upper end of the base, a diffuser having a lower end threadably received in the base, a side wall and a top for defining an enclosed space for a lamp bulb. A lamp shade is mounted on a support is disposed at the top end of the diffuser and extends downwardly in surrounding relation to the diffuser. Set screws are provided for securing the diffuser to the base and the shade to the support.

5 Claims, 1 Drawing Sheet

Fig. 1
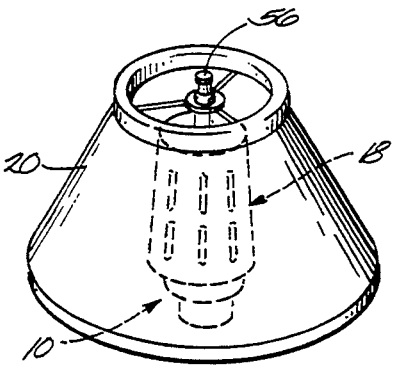
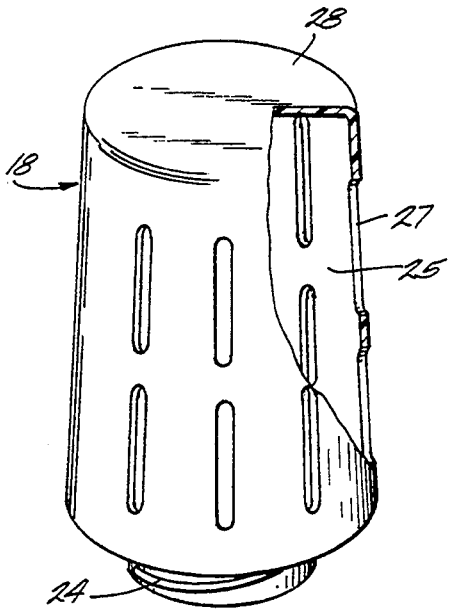
Fig. 3
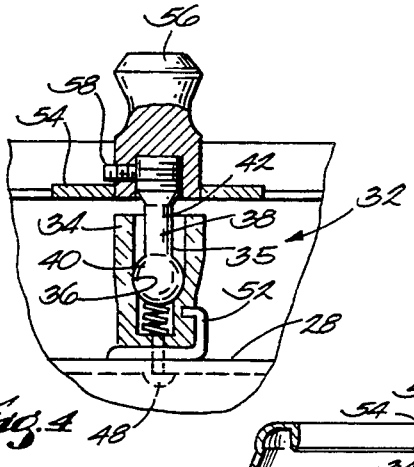
Fig. 4
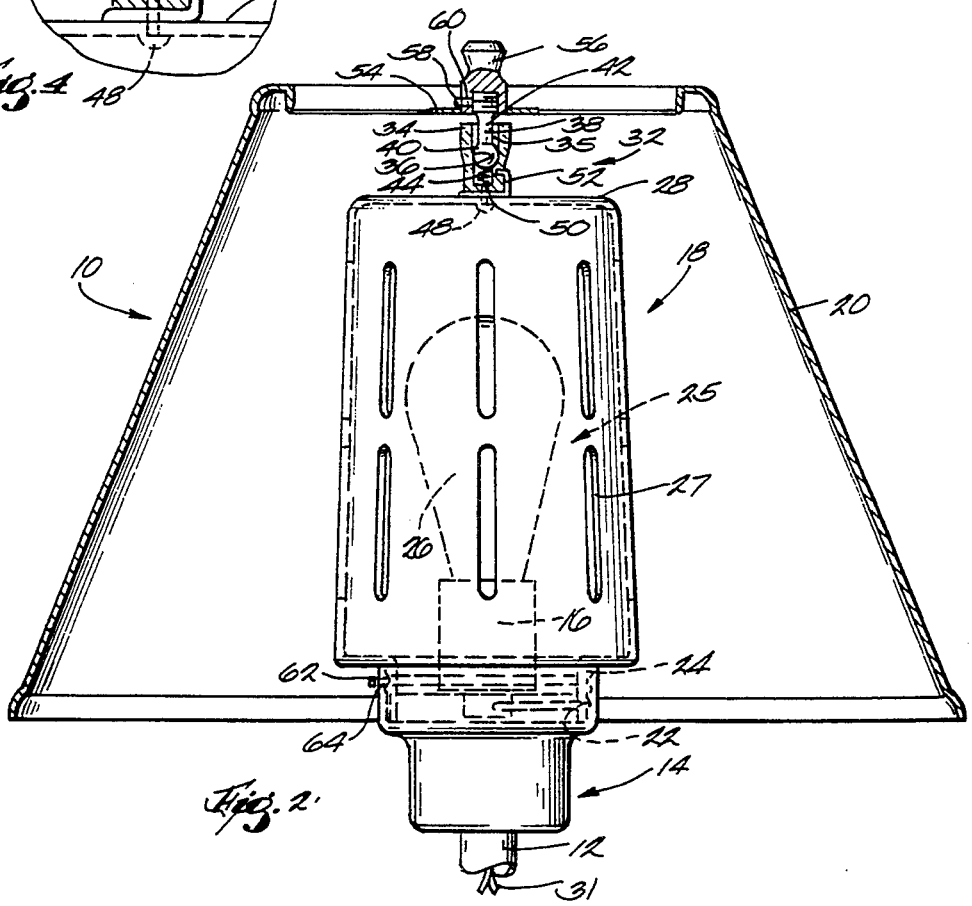
Fig. 2

LAMP HAVING A DIFFUSER AND SHADE

BACKGROUND OF THE INVENTION

This invention relates to lamps and more particularly to lamps for institutional use.

Table and floor lamps used in institutions, such as college dormitories and hospitals, often include means for limiting unauthorized access to the lamp bulbs to minimize vandalism and possible injury. This may, for example, involve the use of metallic baffles or screens. While these measures did adequately prevent unauthorized access, they tended to detract from the lamp's aesthetics. Moreover, these prior art security systems tended to reduce the available illumination from such lamps.

SUMMARY OF THE INVENTION

This invention relates to a new and improved lamp for institutional use.

Another object of the invention is to provide a lamp for institutional use that prevents unauthorized access to the lamp bulb while presenting an aesthetically pleasing appearance and not substantially reducing available illumination.

These and other object and advantages of the invention will become more apparent from the detailed description thereof taken with the accompanying drawings.

In general terms, the invention comprises a lamp having a cup shaped base which is open at its upper end, a lamp socket mounted on the open upper end of the base, a diffuser having a lower end mounted on the base in surrounding relation to the lamp socket, a side wall and a top end for defining an enclosed space for a lamp bulb, a support disposed on the top of the diffuser, and a lamp shade mounted on the support and extending downwardly in surrounding relation to the diffuser.

BRIEF DESCRIPTION OF THE DRAWINGS

FIG. 1 is a prospective view showing the lamp according to the preferred embodiment of the invention. FIG. 2 is a side elevational view, partly in section, of the lamp shown in FIG. 1; and FIG. 3 is a prospective view of a portion of the lamp shown in FIG. 1.

FIG. 4 is a prospective view of a portion of the lamp shown in FIG. 2.

DETAILED DESCRIPTION OF THE PREFERRED EMBODIMENT

The lamp 10 in accordance with the preferred embodiment of the invention is shown in FIG. 1 to include a stem 12, a socket cup 14 suitably mounted adjacent the upper end of stem 12, a socket 16 suitably mounted within the socket cup 14 and located co-axially therewith, a diffuser 18 mounted on the cup 14 and a lamp shade 20 mounted at the upper end of the diffuser 18. The socket cup 14 can be formed of any suitable material such as sheet metal and is open at it's upper end. Internal threads 22 are formed around the upper inner periphery of the cup 14 and in surrounding relation to the socket 16.

The diffuser 18 is generally cylindrical and has a reduced diameter neck portion 24 formed at it's lower end. The neck portion 24 has external threads complimentary to the threads 22 in the cup 14. This permits the diffuser to be threaded into the cup to define an enclosed internal space 25 for enclosing the socket 16 and a lamp bulb 26 disposed therein. The diffuser 18 also has a cylindrical side wall 27 and a circular top 28. Vent openings 30 are preferably provided in the side walls 27 of diffuser 18 to minimize the build-up of heat within the enclosed space 25. In order to prevent access to the lamp bulb, the vent Openings 30 may be elongated slits as shown in FIG. 1. Those skilled in the art will appreciate that the socket 36 will be connected by electrical conductors 31 to a plug or the like so that the lamp bulb 27 can be energized. An on-off switch (not shown) for connecting the socket to an energy source may be suitably located on the socket cup 14, the stem 12 or a base (not shown) which supports the stem 12 vertically. The diffuser 18 may be formed of suitable plastic or glass material and is preferably translucent.

A support 32 for the lamp shade 20 is mounted at the top 28 of the diffuser 18. The support 32 includes a base 34 having an internal cavity 35 which defines a spherical socket 36 at it's lower end and which is open at it's upper end. A support member 38 is disposed in the cavity 35 and includes a ball 40 at it's lower end, a shank 42 extending upwardly from the ball 40 and being threaded at it's upper end. The ball 40 is disposed in and is complimentary to the socket 36 so that the support member 38 may be pivoted in any direction through small vertical angles. A spring 44 may be disposed in a recess 46 formed in the socket 36 and bears against the ball 40 to prevent free movement of member 38. The support 32 is fixed to the diffuser in any suitable manner such as by means of a screw 48 which passes through a small central opening in the top 38 of diffuser 18 and into a threaded hole 50 in the lower end of support 32. In addition, a metallic clip 52 may be provided to prevent the support 32 from rotating.

The shade 20 is conventional and includes a mounting ring 54 which is received over the threaded upper end of the member 36 and is secured thereto by means of an internally threaded finial 56. The finial 56 is secured to the member 38 against casual removal by means of a set screw 58 which extends through a threaded aperture 60 formed in finial 52 and normal to the axis of member 38. Similarly, a second set screw 62 extends through a threaded hole 64 and the cup 14 and bears against the neck 22 of diffuser 18 to prevent casual removal of the diffuser from the cup 14.

While the diffuser 18 is shown in the drawing to be cylindrical, it may have any conventional shape as desired. In addition, while a incandescent lamp 26 is shown, it will be appreciated that a fluorescent lamp may also be employed. If the fluorescent lamp is not internally ballasted, a ballast may be located within the socket cup 14.

While only a single embodiment of the invention has been illustrated and described, it is not intended to be limited thereby but only by the scope of, the appended claims.

I claim:

1. A lamp including a first support which is cup shaped and has an open upper end, a lamp socket mounted in the open upper end of the first support, a diffuser mounted on the first support in surrounding relation to the lamp socket and defining an enclosed space for a lamp bulb, and a lamp shade, said diffuser having a generally cylindrical sidewall, a top and a lower neck portion, the open upper end of said first support and the neck portion of said diffuser having complimentary threads so that the neck portion may be threaded into said first support to define an enclosed space, vent openings formed in the cylindrical side wall of said diffuser, a first threaded member mounted on the top of said diffuser, a second threaded member for threadably engaging said first threaded member, said shade including a mounting member received between said first and second threaded members, first releasable locking means for preventing the removal of said lamp shade from the upper end of said diffuser and second releasable locking means for engaging threaded portions of said first support and said diffuser to prevent the removal of said diffuser from said first support.

2. A lamp including a first support which is cup shaped and has an open upper end, a lamp socket mounted in the open upper end of said first support, a generally cylindrical diffuser mounted on said first support and in surrounding relation to the lamp socket and defining an enclosed space for a lamp bulb, and a lamp shade, said diffuser having a generally cylindrical side wall, a top portion and a lower neck portion, the open upper end of said first support and said neck portion having complimentary coupling means for mounting said neck portion on said first support to define an enclosed space, vent openings formed in the cylindrical side wall of said diffuser, a first member mounted on the top of said diffuser and including a first coupler, a second member including a second coupler for being coupled to said first member, said shade including a mounting member received between said first and second members whereby said shade is mounted solely on the upper end of said diffuser.

3. The lamp set forth in claim 2 wherein said first and second couplers comprise complimentary threads whereby said first member is threadably received on said second member, said mounting member being disposed therebetween.

4. The lamp set forth in claim 3 wherein said first support and the neck portion of said diffuser having complimentary threads so that the neck portion may be threaded into said first support to define the enclosed space.

5. The lamp set forth in claim 2 and including first release of a locking means for preventing the removal of said lamp shade from the upper end of said diffuser and second releasable locking means for engaging the threaded portions of said first support and said diffuser to prevent the removal of said diffuser from said first support.

* * * * *